US005556068A

United States Patent [19]

Gorelik

[11] Patent Number: 5,556,068

[45] Date of Patent: Sep. 17, 1996

[54] PEGBOARD ARTICLE HOLDER

[76] Inventor: Yakov Gorelik, 270 N. Chesterfield Rd., Columbus, Ohio 43209-1200

[21] Appl. No.: 325,106

[22] Filed: Oct. 17, 1994

[51] Int. Cl.[6] ..... A47F 5/00

[52] U.S. Cl. ..... 248/220.41; 248/302; 248/214; 248/510

[58] Field of Search ..... 248/220.41, 221.11, 248/223.21, 302, 510, 500, 505, 71, 73, 316.1, 309.1, 214; 211/70.6

[56] References Cited

U.S. PATENT DOCUMENTS

| | | | |
|---|---|---|---|
| 938,082 | 10/1909 | Siegel | 248/505 X |
| 2,065,843 | 12/1936 | Van Uum | 248/71 X |
| 3,131,896 | 5/1964 | Ingraham | 248/505 X |
| 3,275,274 | 9/1966 | Hutcheon | 211/70.6 X |
| 3,313,511 | 4/1967 | Koerner et al. | 248/505 X |
| 3,481,487 | 12/1969 | Paruolo | 248/220.4 X |
| 3,650,502 | 3/1972 | Langhi | 248/220.4 |
| 3,682,426 | 8/1972 | Owen | 248/220.4 |
| 3,709,452 | 1/1973 | Feeny | 248/221.1 |
| 4,476,983 | 10/1984 | Fast | 248/220.4 X |
| 4,645,154 | 2/1987 | Bly | 248/220.4 |

FOREIGN PATENT DOCUMENTS

| | | | |
|---|---|---|---|
| 271447 | 3/1964 | Australia | 248/220.4 |
| 662468 | 8/1929 | France | 248/505 |
| 2610446 | 9/1977 | Germany | 248/220.4 |
| 2026850 | 2/1980 | United Kingdom | 248/220.4 |

*Primary Examiner*—Karen J. Chotkowski
*Attorney, Agent, or Firm*—Thomas S. Baker, Jr.

[57] ABSTRACT

An article holding assembly for a pegboard having a plurality of cruciform slotted openings is provided with at least one article-holding support bracket that has a pair of arms each having a resilient U-shaped clip end portion that clamps the support bracket tightly to the pegboard in either a vertical or horizontal position.

6 Claims, 2 Drawing Sheets

PEGBOARD ARTICLE HOLDER

FIELD OF THE INVENTION

This invention relates generally to apertured pegboard assemblies of the type used for holding or displaying articles such as tools, bottles, merchandise items, etc. More particularly, it concerns a pegboard having multiple cruciform slotted openings, and one or more article holding brackets having resilient U-shaped clip elements for engaging the brackets tightly to the pegboard.

BACKGROUND OF THE INVENTION

Perforated pegboard with detachably mounted supporting means for displaying articles in shops or storing tools in various out-of-the-way places are well known in the art. Traditionally, the pegboards have circular apertures and the supporting means are formed from a rod having a circular cross-section with inner ends shaped and spaced to simultaneously engage two or more apertures in the pegboard. In an effort to improve the stability of articles mounted on a pegboard and to enable the article supporting means to be mounted in both horizontal and vertical orientations, pegboards having cruciform apertures and article supporting means with T-shaped clips have been developed.

Such a device may be seen in United Kingdom Patent Application No. GB 026 850A granted to Schucom B. V., which discloses a system for detachably fastening articles to a pegboard perforated by cruciform openings. In this system the articles are held in article holders with T-shaped clips which attach the article holders to the pegboard. Because the distance between the articles themselves and the pegboard wall is considerable, this system is inconvenient for supporting heavy tools. The article holders do not accommodate pegboard walls having a range of thicknesses.

A pegboard with cruciform holes also is disclosed in Australian Patent No. 271447, granted to RICHARDSON & SONS LTD. Here, article holders mounted on vertical plates are attached to a pegboard by passing parallel lugs at the edge of the plates through selected slots of the pegboard. Again, the articles themselves are supported at a considerable distance from the pegboard. The article holders must remain in a vertical orientation and they do not accommodate pegboard walls having a range of thicknesses.

A retention clip for a tablecloth may be seen in U.S. Pat. No. 4,158,905 to O'Leary. This clip is U-shaped and serves to overlie the top and bottom surfaces of a table. However, the clip does not have a leg which may be passed through an opening to engage a pair of walls which partially define the opening and it is not attached to an article holding bracket.

The prior art inventions use rigid constructions for the article holder or supporting means and the pegboard. Therefore, the openings in the pegboard must be sized such that the supporting means may be mounted and detached easily. Also, they must be sized to accommodate manufacturing variances which may occur in the pegboard and in the supporting means. Thickness variations in the pegboard also occur due to wear that occurs at a pegboard aperture due to repeated insertion and removal of an attaching means. This ultimately may result in a rather loose attachment of the supporting means to the pegboard such that when the pegboard is shaken or jolted, the supporting means become dislodged from the pegboard. The cited prior art inventions do not address the problem of tightly securing an article supporting means to pegboards having a range of thicknesses due to wear or manufacturing tolerances.

SUMMARY OF THE INVENTION

The present invention includes a pegboard, perforated to have a plurality of cruciform slotted through-openings, and one or more article holding brackets which cooperate with the pegboard. Each bracket has at least two arms and each arm has a resilient U-shaped clip at its outer end. The article holding brackets are attached to the pegboard by passing the rear leg of the U-shaped clips at the outer ends of the arms through slots of the cruciform openings and sliding the clips to one end of the slot in order to clamp the clips and the supporting bracket to the pegboard. Because the rear legs are resiliently biased, they clamp tightly to a pegboard wall, even if the thickness of the pegboard wall varies to some extent. By passing the rear legs of the U-shaped clips through either the vertical or the horizontal slots of the cruciform opening, the supporting brackets may be mounted vertically or horizontally. The U-shaped clips are sized to fit into the slots of the pegboard's opening, and the arms of the supporting brackets are designed such that the distance between the U-shaped clips of the arm elements corresponds to a distance between selected parallel cruciform openings on the pegboard.

In the present invention, the distance between the pegboard and the article held by the article holding bracket is reduced to a minimum, what makes the system convenient for supporting heavy articles.

DETAILED DESCRIPTION

Figure 1:
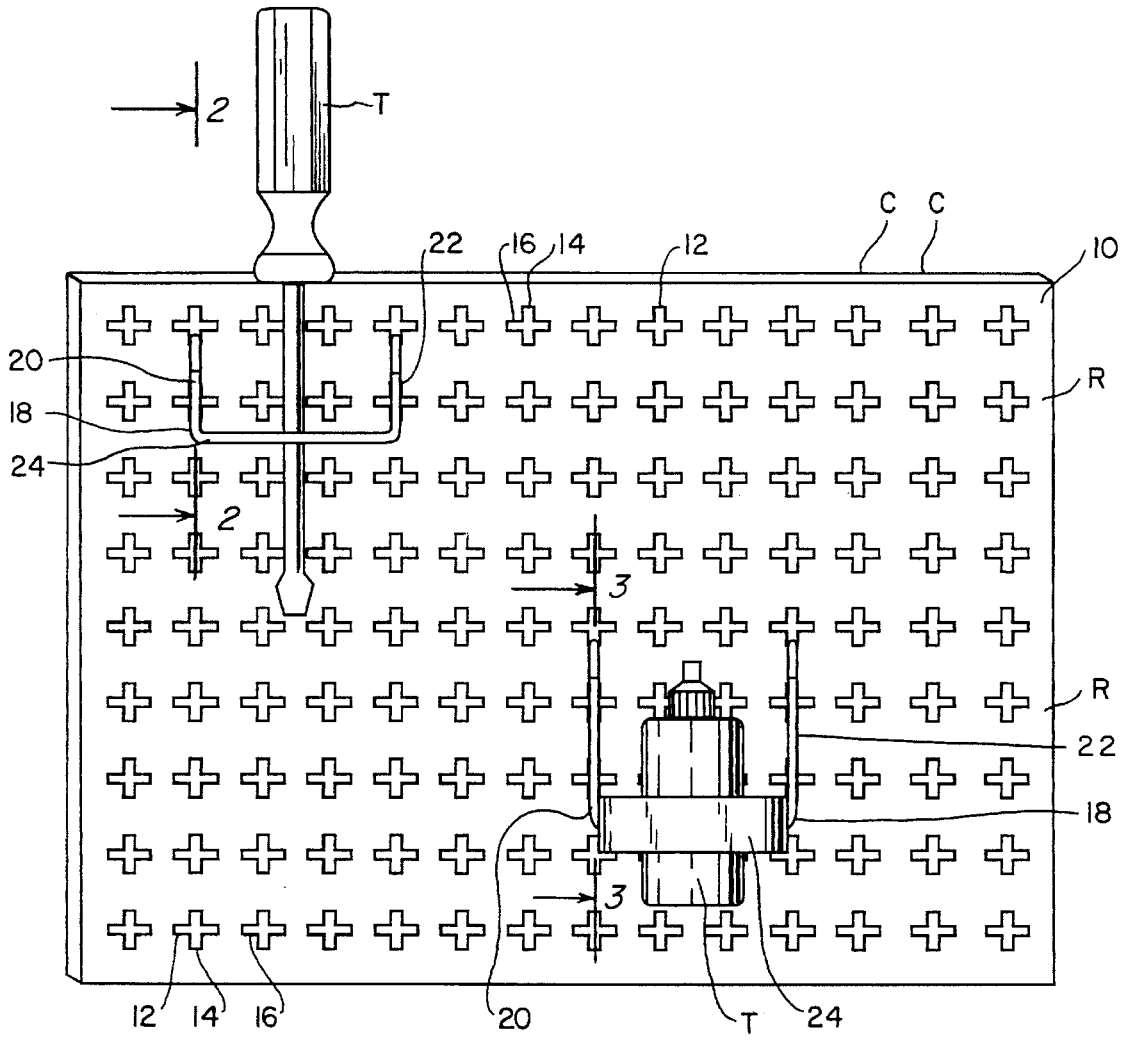
FIG. 1 is a plan view of a preferred embodiment of the pegboard assembly of this invention.
Figure 2:
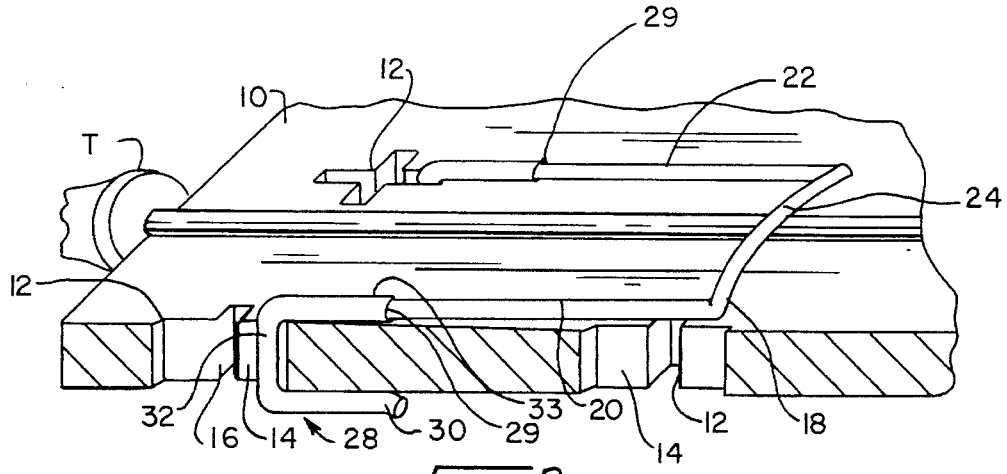
FIG. 2 is a partially-sectioned perspective view taken along line 2—2 of FIG. 1.
Figure 3:
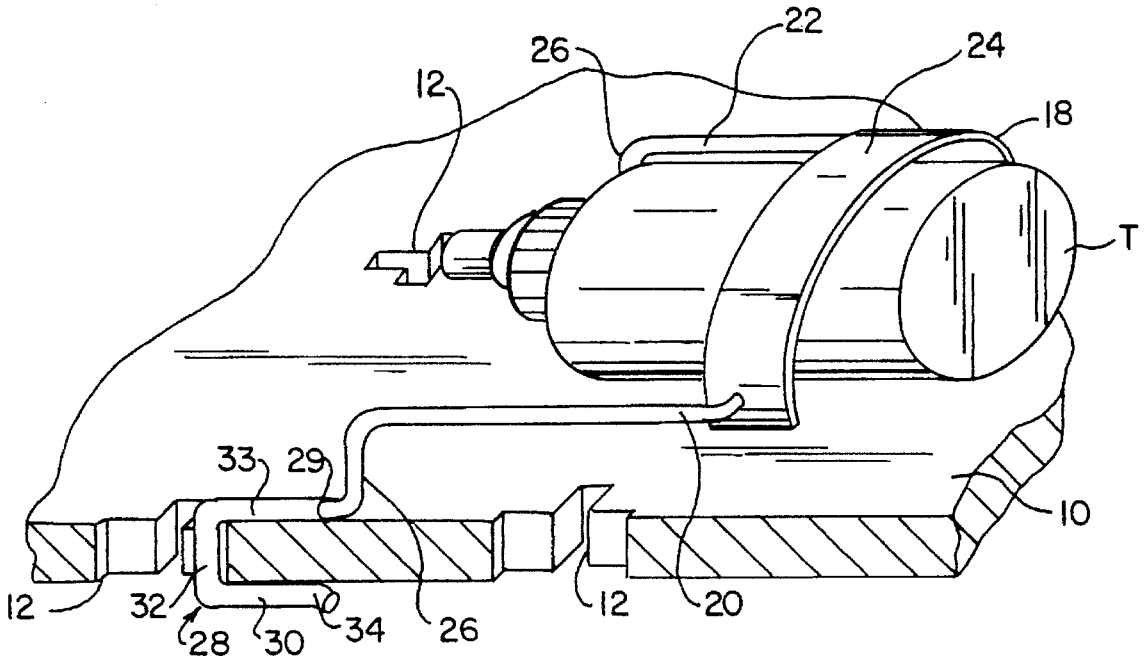
FIG. 3 is a partially-sectioned perspective view taken along line 3—3 of FIG. 1.

Referring to FIGS. 1 through 3, it may be observed that a pegboard (10) has a plurality of horizontal rows (R) and vertical columns (C) of aligned cruciform shaped openings (12). Each opening (12) is defined by a pair of vertical and horizontal slots (14 and 16) which intersect at their midpoints. It may be observed that each of the vertical slots (14) of the cruciform shaped openings (12) in a vertical column (C) are aligned and that each of the horizontal slots (16) of the cruciform shaped openings (12) in a row (R) are aligned.

A plurality of support brackets (18) mount items (T) such as tools, containers, etc. on pegboard (10). Each bracket (18) has a pair of parallel, longitudinally extending arms (20 and 22) attached at one end to a central tool engaging element (24). Generally, the arms (20 and 22) of support bracket (18) lie against the face of pegboard (10) when the bracket (18) is mounted thereon. However, the arms (20 and 22) may have a lateral offset portion (26) which serves to lift the arms (20 and 22) above the surface of the pegboard (10). See FIG. 3.

Turning to FIGS. 2 and 3, it may be observed that a U-shaped clip (28) is affixed to one end (29) of each arm (20 and 22). Each U-shaped clip (28) has a rear leg (30), a lateral leg (32) and a front leg (33) attached to an arm (20 and 22).

It has been found advantageous to have rear leg (30) and front leg (33) of each U-shaped clip (28) resiliently biased towards each other. Rear leg (30) and front leg (33) are formed from a spring like material which is more resilient than that of the arms (20 and 22). Thus, each rigid arm (20 and 22), tends to pivot about its point of attachment at its outer end (29) to clip (28) when the bracket (18) engages an item (T). This enables the clip (28) to remain firmly attached to the pegboard (10). Resiliently biasing rear leg (30) towards front leg (33) enables each of the U-shaped clips (28) to securely clamp pegboard (10) regardless of minor variations in the thickness of the pegboard caused by insertion and removal of the brackets (18) and by manufacturing tolerances.

It should be noted that rear leg (30) of each U-shaped clip (28) has a length slightly less than that of the vertical and horizontal slots (14 and 16) which form the cruciform shaped openings (12). Consequently, when a support bracket (18) is mounted on pegboard (10), the rear legs (30) of the clips (28) at one end of the arms (20 and 22) are pushed through pairs of aligned vertical or horizontal slots (14 and 16). If the support bracket (18) is to be mounted in a horizontal position, the rear legs (30) are inserted in pairs of horizontal slots in the same column (C) of pegboard (10) whereas if a support bracket (18) is to be mounted in a vertical mode, the rear legs (30) are inserted in spaced pairs of vertical slots (14) in the same row (R). Thereafter, the bracket (18) is moved in a direction that will cause the rear and front legs (30 and 33) to securely clamp the pegboard (10) therebetween.

Figure 4:
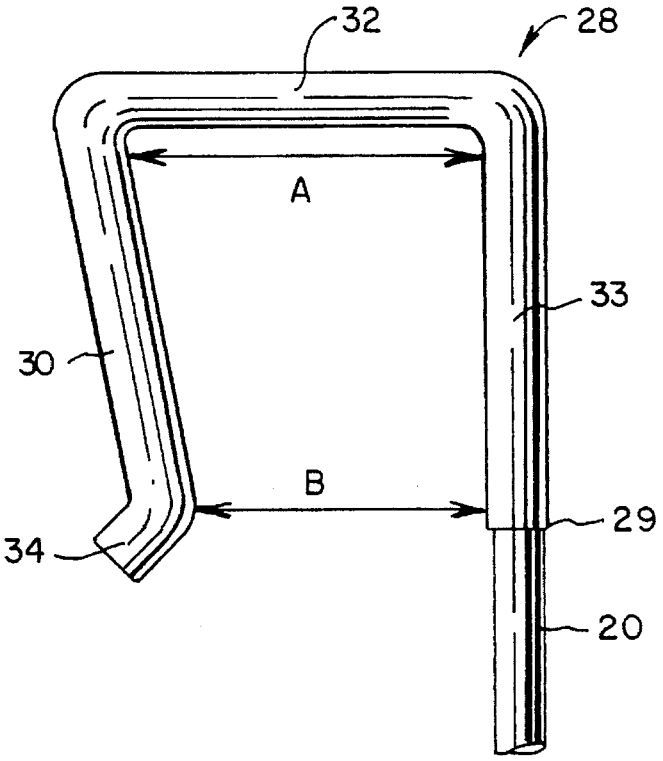
FIG. 4 is an elevational view of a resilient clip at one outer end of an arm of a support bracket.

Referring to FIG. 4, it may be observed that U-shaped clip (28) is formed such that the length A of lateral leg (32) is greater than the distance B which represents the distance between the point at the end (29) of arm (20) to which U-shaped clip (28) is affixed and the outer end (34) of rear leg (30). Typically, the length A of lateral leg (32) is greater than the thickness of pegboard (10) whereas the distance B between the outer end (34) of rear leg (30) and its respective arm (20) is less than the thickness of a pegboard (10). With this configuration clip (28) securely clamps pegboards (10) having a range of thicknesses.

Typically the U-shaped clips (28) are formed as separate plastic or metal tubular elements and pushed on to the outer ends (29) of the arms (20 and 22). However, the clips (28) also may be attached to the arms (20 and 22) by welding. Additionally, the distance between the arms (20 and 22) of each bracket (18) should match the distances, either in the vertical or in the horizontal direction between two parallel cruciform slots.

Turning to FIGS. 1 and 2, it may be observed that the shank of a tool T is clamped against pegboard (10) by a bracket (18). The shank is clamped by the central tool engaging element (24) of bracket (18). In the bracket (18) depicted in FIGS. 1 and 2, the arms (20 and 22) are pivoted upwardly about their outer ends (29) where they attach to the U-shaped clips (28). Thus, the arms (20 and 22) are raised slightly above the surface of the pegboard (10). It may be observed that the U-shaped clips (28) affixed to the arms (20 and 22) pass through slots (14) in a pair of cruciform openings (12) in the same row (R) and the bracket is moved such that the rear and front legs (30 and 33) of the clips (28) firmly engage pegboard (10).

Turning to FIGS. 3 and 4, it may be observed that bracket (18) is being utilized to clamp a container T to the surface of pegboard (10). In this embodiment of the invention the arms (20 and 22) of bracket (18) incorporate a lateral offset (26). This serves to increase the distance a central tool engaging element (24) for bracket (18) is spaced from the pegboard (10) and thereby enables the bracket to accommodate larger items. Of course, central tool engaging element (24) may be adjusted in size and configuration to accommodate different shaped articles clamped against pegboard (10) by support bracket (18).

Since certain changes may be made in the above-described system and apparatus without departing from the scope of the invention herein and above, it is intended that all matter contained in the description or shown in the accompanying drawings shall be interpreted as illustrative and not in a limiting sense.

I claim my invention as follows:

1. An article holding assembly which comprises;

a pegboard having a front surface, a rear surface and a plurality of cruciform openings which extend between said front and rear surface and each defined by a horizontal slot and a vertical slot;

a support bracket having a pair of arms and a central tool engaging element therebetween;

a U-shaped clip end attached to one end of each arm for mounting the support bracket to said pegboard;

wherein each of said U-shaped clip ends has a front leg, a back leg, a lateral leg intermediate said front leg and said back leg, and said front leg is connected to one end of said back leg by a lateral leg;

wherein each of said front legs is attached to the outer end of one of said arms;

wherein each of said back legs extends substantially parallel to said arm adjacent said front leg;

wherein each of said back legs has a length less that of said horizontal and lateral slots such that said back legs are adapted to pass through said horizontal and vertical slots; and wherein at least one of said back and front legs of said U-shaped clip is resiliently biased toward the other of said back and front legs to tightly clamp said front leg to said front surface of said pegboard and said back leg to said rear surface of said pegboard.

2. The article-holding assembly defined by claim 1 wherein said central tool engaging element is bent outwardly such that a tool may be received between said central tool engaging element and said pegboard.

3. The article-holding assembly of claim 1 wherein each of said arm elements has a lateral offset portion.

4. The article holding assembly of claim 1 wherein the length of said lateral leg is greater than the distance between the outer end of said back leg and said arm.

5. An article-holding assembly adapted to engage a pegboard having front and rear surfaces and a plurality of cruciform openings each defined by a horizontal slot and a vertical slot which comprises:

a support bracket having a pair of arms and a central tool engaging element therebetween;

a U-shaped clip end attached to one end of each arm for mounting the support bracket to said pegboard;

wherein each of said U-shaped clip ends has a front leg, a back leg, a lateral leg intermediate said front leg and said back leg and said front leg is connected to one end of said back leg by said lateral leg;

wherein each of said front legs is attached to the outer end of one of said arms;

wherein each of said back legs has a length less that of said horizontal and lateral slots such that said back legs are adapted to pass through said horizontal and vertical slots;

wherein each of said back legs extends substantially parallel to said arm adjacent said front leg;

wherein at least one of said back and front legs of said U-shaped clip is resiliently biased toward the other of said back and front legs to tightly clamp said front leg to said pegboard front surface and said back leg to said pegboard rear surface; and wherein said front and back legs are made from a spring like material which is more yieldable than said arms such that said front and back legs may pivot at their outer ends with respect to said arms.

6. An article-holding assembly which comprises;

a pegboard having a front surface, a rear surface and a plurality of cruciform openings which extend between said front and rear surface and each defined by a horizontal slot and a vertical slot;

a support bracket having a pair of arms and a central tool engaging element therebetween;

a U-shaped clip end attached to one end of each arm for mounting the support bracket to said pegboard;

wherein each of said U-shaped clip ends has a front leg, a back leg, a lateral leg intermediate said front leg and said back leg, and said front leg is connected to one end of said back leg by a lateral leg;

wherein each of said front legs is attached to the outer end of one of said arms;

wherein each of said back legs extends substantially parallel to said arm adjacent said front leg;

wherein at least one of said back and front legs of said U-shaped clip is resiliently biased toward the other of said back and front legs to tightly clamp said front leg to said front surface of said pegboard; and wherein said front and back legs are made from a spring like material which is more yieldable than said arms such that said front and back legs may pivot at their outer ends with respect to said arms.

* * * * *